United States Patent [19]

Barron

[11] 4,099,440

[45] Jul. 11, 1978

[54] PLECTRUM PIANO ACTION

[76] Inventor: Ellis Barron, 7228 Eads Ave., La Jolla, Calif. 92037

[21] Appl. No.: 747,798

[22] Filed: Dec. 6, 1976

[51] Int. Cl.[2] ..... G10C 1/06

[52] U.S. Cl. ..... 84/258

[58] Field of Search ..... 84/258, 320, 321, 8, 84/9

[56] References Cited

U.S. PATENT DOCUMENTS

| | | | |
|---|---|---|---|
| 796,878 | 8/1905 | Spurgeon | 84/320 |
| 933,670 | 9/1909 | Schenuit | 84/320 |
| 1,462,444 | 7/1923 | Casciotta | 84/258 |
| 1,624,061 | 4/1927 | Nesseler | 84/320 |
| 3,478,630 | 11/1969 | Cucchiara | 84/258 |

*Primary Examiner*—Lawrence R. Franklin

[57] ABSTRACT

An improvement in the action for a plectrum piano in which a pneumatic piston and cylinder are used to produce a variable pluck loudness, the reaction of the piston urging the plectrum toward the musical string in proportion to key-lever velocity. A rotatable pick-rod is used to carry the plectrum, the pick-rod being connected to the piston by means of a crank arm such that the plectrum is also rotated into the string during the pluck.

2 Claims, 5 Drawing Figures

2
3
4
13
14
16
38
37
33
33a
34
12
15
32
22
36
7
8
9
20
6
10
11
23
21
24
25
5
5a
4
3
2
1
26
31
30
29
27
28a
28

39
40
40a

PLECTRUM PIANO ACTION

SUMMARY OF THE INVENTION

The present invention relates to musical instruments of the harpsichord or plectrum piano type wherein the strings are made to sound by a plucking action rather than by being struck with hammers as in the modern piano. In particular the invention involves the application of fluid mechanics to the action of such plectrum instrumentsin order to provide the "piano-forte" or soft-loud characteristic of the piano.

Heretofor a weight or similar inertia element has been employed to produce this loudness variation but such designs have an inherent defect in that they must include some means of controlling or containing the motion of the weight, especially during heavy pluck action. Furthermore such designs are difficult to make sound dependably at key velocities approaching a constant value, since for these velocities the inertial forces are zero.

In my novel action hereinafter decribed I have overcome these difficulties by using a pneumatic piston of light weight, the piston having a vent and sliding in a co-acting cylinder so as to provide a velocity dependent resistance force, this force being applied laterally to the plectrum element to produce a variable pluck force. I have also made the plectrum angle itself responsive to this piston resistance force, thus a additionally increasing the dynamic range of the instrument. In addition to the dynamic or "piano-forte" effect my new action provides the player with a rapid repeat pluck and an improved "feel" of the actual plucking action itself. Such action will be more fully set fort and claimed in the following specifications and accompanying drawings.

Figures 1, 2, 3, 4, 5:
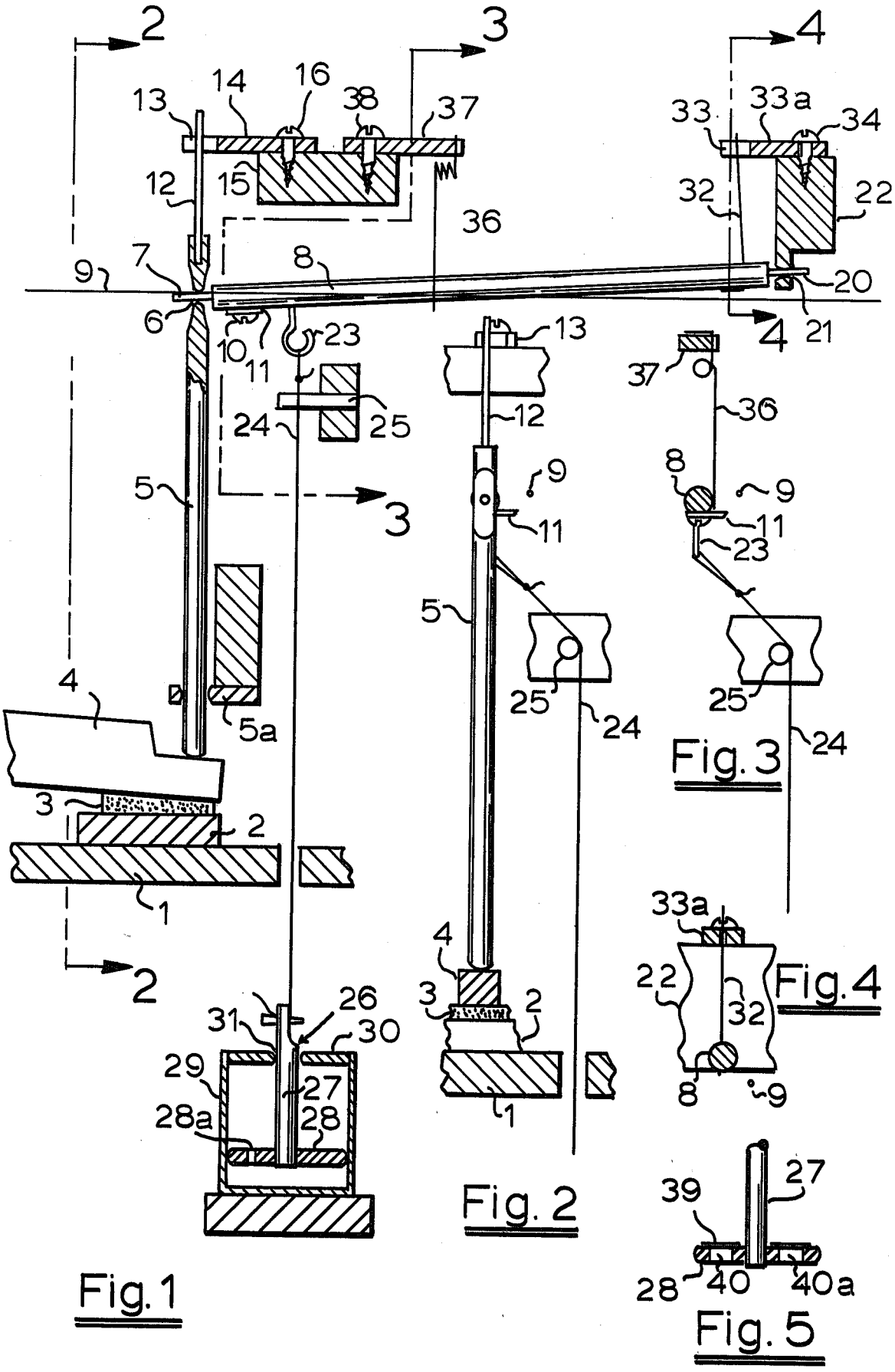
FIG. 1 is a side elevation of my novel plectrum piano action showing the action parts and showing also the rearward end of the conventional piano key-lever. Shown in section are the pneumatic piston and cylinder, a portion of the bottom of the instrument, and certain support members for the action. The figure shows the action parts for one string or one note of the instrument, it being understood that the parts are repeated for each of the other strings.
FIG. 2 is a front elevation view of the action showing in section the key-lever and instrument bottom. The pneumatic piston and cylinder are omitted as they would appear the same as in FIG. 1.
FIG. 3 is a section view taken through 3—3 of FIG. 1 showing the pick rod, plectrum, and crank, and indicating the essential action of my novel plectrum piano. Those parts beyond the section view are omitted for clarity.
FIG. 4 is a section view taken through 4—4 of FIG. 1 and shows also a portion of the rear support member.
FIG. 5 shows a modification of the pneumatic piston wherein the latter is provided with a flap valve to increase the repetition rate of the pluck.

Refering now to FIGS. 1 through 4, wherein like numbers represent like parts throughout, I show as 1 a portion of the instrument bottom upon which rests the conventional key-frame back rail 2 and back rail felt 3, the latter receiving the rearward portion of the conventional key-lever 4. When the instrument is played, key-lever 4 rises and through jack 5 raises pick-rod 8 past the musical string 9. This motion is enabled by providing jack 5 with chamfered hole 6 which receives pin 7, the latter fixed in pick-rod 8. Jack 5 is laterally restrained at the lower end by guide 5*a*. Fixed to the under side of pick-rod 8 by means of screw 10 is plectrum 11. The plectrum may be made from any appropriate sheet material such as leather or plastic. Jack 5 is also provided with a resilient extension pin 12 which works in slot 13 of clip 14, the latter adjustably fixed on support 15 with screw 16. Clip 14 is adjusted to control the lateral limits of jack 5 motion. The pick-rod 8 is provided with a second pin 20 at the opposite or rearward and thereof, which pin is received in hole 21 in fixed support 22 so that the rod is freely rotatable about it's axis. Hole 21 is chamfered to allow a limited pivoting motion of the pick-rod 8 in both vertical and horizontal directions. The pick-rod 8 is also provided with screw-eye 23 which forms a crank thereon and to which is fastened draw-string 24, the latter being led over smooth pin 25 and downward to the pneumatic piston 26 formed by rod 27 and disc 28. Disc 28 is provided with a vent hole 28*a* and is made to fit hollow cylinder 29 in such a way that resistance to piston motion is produced by air flowing from one side of the disc 28 to the other. Cylinder 29 is fitted with a cover 30 containing bearing hole 31 to guide the piston rod 27.

Pick-rod 8 is further provided with spring 32 fixed to the rear end thereof and extending upward therefrom to a slot 33 in clip 33*a*, the latter being adjustable laterally on support 22 with screw 34. Spring 32 resists the weight of the piston 26 and determines the angle at which the plectrum 11 approaches the musical string 9. Still further, pick-rod 8 is provided with escape spring 36 bearing against the side thereof, and also resisting the weight of piston 26, said spring being carried by clip 37, the latter being adjustably fixed to support 15 with screw 38.

The plucking action of my invention can now be described as follows. As the pick-rod 8 is raised by jack 5, the piston 26 will also rise through the action of draw-string 24. The more rapid the key-lever motion the greater the resistance presented by piston 26 and the more the plectrum will be drawn laterally into the musical string 9 and the greater the resulting pluck loudness. Also, because of screw-eye 23, which acts as a crank on pick-rod 8, the more the plectrum itself will resist rotation thus further increasing the pluck loudness. When the key-lever is released after the pluck the piston velocity will be near zero and escape spring 36 will force the pick-rod 8 away from the musical string 9 causing the plectrum 11 to avoid said string during the down stroke.

Refering now to FIG. 5, I show a modification of my plectrum action wherein the piston vent area is enlarged and provided with a thin cover disc 39 to act as a gravity actuated flap valve. The vent is shown as holes 40 and 40*a* and acts only on the return or down stroke of the pluck, the pluck stroke resistance being provided by air flow around the edges of piston disc 28. Such modificaton allows an improved repetiton repetition rate for the action.

It should be noted that the lateral spacing of the several strings in the complete instrument can be reduced in half by placing adjacent cylinders one in front of the other in the direction of the strings. The spacing can again be halved by supporting each alternate pair of cylinders one pair above the other.

My invention having been described in detail in the foregoing is now finally and formally described and delineated hereunder in the claims subjoined, it being understood that such claims include and cover such modifications, changes, and additions as would occur to those skilled in the subject art.

I claim:

1. In a musical instrument of the harpsichord or plectrum piano type, a plucking means for each string thereof consisting of a key-lever and a plectrum, wherein the improvement comprises:

(a) a cylinder means, hollow, closed at one end, and fixed in the instrument, (b) a piston means having a vent hole and being coaxially slideable within said cylinder means, the combination causing the piston to present a velocity dependent resistance force to motion thereof, (c) a rotatable pick-rod carrying the plectrum and having a depending crank arm, said pick-rod supported so as to allow limited vertical and horizontal pivoting motion thereof, (d) jack means connecting the pick-rod to the key-lever, (e) means connecting the piston to said crank arm such that a portion of key-lever motion is coupled to said piston, the resistance force thereof tending to draw the pick-rod toward the string and to rotate the plectrum into said string, (f) a first spring means engaging the pick-rod and opposing said piston resistance force so as to cause the plectrum to avoid the string upon release of the key-lever; and (g) a second spring means fixed to said pick-rod and opposing rotation thereof for the purpose of controlling plectrum angle.

2. The claim according to claim 1 wherein the piston vent hole is provided with a moveable cover thereon, the combination forming a flap valve to increase the pluck repeat rate.

* * * * *